US005282692A

United States Patent [19]

McLeod

[11] Patent Number: 5,282,692

[45] Date of Patent: * Feb. 1, 1994

[54] ASSEMBLY OF ARTICULATED MEMBERS FOR FORMING A SURFACE

[76] Inventor: Warren H. McLeod, 566 Parker Ave., Brick, N.J. 08742

[ * ] Notice: The portion of the term of this patent subsequent to Jun. 2, 2009 has been disclaimed.

[21] Appl. No.: 913,439

[22] Filed: Jul. 14, 1992

[51] Int. Cl.[5] ..... E01C 5/20; E01C 9/00

[52] U.S. Cl. ..... 404/35; 404/36; 428/33; 428/54; 428/138

[58] Field of Search ..... 404/35, 36, 37, 38, 404/46, 64; 14/2.4, 73.1; 428/53, 54, 33, 36.9, 138

[56] References Cited

U.S. PATENT DOCUMENTS

| | | | |
|---|---|---|---|
| 305,328 | 9/1984 | Peck | 94/6 |
| 399,879 | 12/1976 | Stachiw et al. | 428/53 |
| 3,595,140 | 7/1971 | Landin | 94/4 |
| 3,685,403 | 8/1972 | Domnick | 94/13 |
| 3,912,408 | 10/1975 | Domnick | 428/54 |
| 4,047,257 | 9/1977 | Bondarchuk, Sr. | 404/35 |
| 4,654,245 | 3/1987 | Balzer et al. | 428/52 |
| 4,681,482 | 7/1987 | Arciszewski et al. | 14/27 |
| 4,766,020 | 8/1988 | Ellingson, Jr. | 428/53 |
| 4,804,570 | 2/1989 | Bedics | 404/35 |
| 5,118,542 | 6/1992 | McLeod | 404/35 X |

FOREIGN PATENT DOCUMENTS

| | | |
|---|---|---|
| 3124555 | 3/1982 | Fed. Rep. of Germany . |
| 3111005 | 9/1982 | Fed. Rep. of Germany . |
| 3219735 | 1/1983 | Fed. Rep. of Germany . |
| 2222873 | 10/1974 | France . |
| 2619845 | 3/1989 | France . |

OTHER PUBLICATIONS

Leichtung Workshops, Our 15th Anniversary Year, Mar. 1989.

Solutions Catalog (1991).

*Primary Examiner*—William P. Neuder

*Attorney, Agent, or Firm*—Mathews, Woodbridge & Collins

[57] ABSTRACT

A plurality of rigid bars, made of wood, plastic or other material, are joined together to form an articulated assembly. A rope is threaded through bores formed in the bars. Spacers are placed over the rope between the bars. Ends of the spacers can be angled for inclining, declining or flat arrangements of adjacent bars. In the alternative, ends of spacers can be rounded and received in a rounded depression of the bore. In an alternate embodiment, flexible interlocking elements are connected to adjacent bars. Interlocking elements can have engaging male and female portions or can be screwed together. Each male and female portion can pass through a plurality of bars. When laid flat over a surface, the articulated assembly may be used as a support that forms a deck, walkway, or similar structure. Other uses of the assembly include a latticework, a barrier and a vertical support.

31 Claims, 13 Drawing Sheets

ASSEMBLY OF ARTICULATED MEMBERS FOR FORMING A SURFACE

BACKGROUND OF THE INVENTION

1. Field of the Invention

The present invention relates to flexible surfaces for use as walkways, roadways, support barriers or the like and, more particularly, to a system of articulated rigid members that may be mounted to form a surface.

2. Description of the Prior Art

In the past, it has been the general practice to employ various assemblies of inter-linked members for covering a strip of ground to provide a temporary or emergency path. Typically, such assemblies comprise a number of rigid members flexibly linked by means of a flexible rope on which the members are threaded or by means of interlocking elements that are attached to and extend between adjacent members. The flexibility of the rope and the interlocking elements enable the assemblies to be laid on an uneven strip of ground or other surface and to be rolled up for storage or for moving them about. Examples of such prior art assemblies may be found in the following U.S. Pat. Nos. 3,685,403; 3,595,140; 4,681,482; 4,047,257; and 3,912,408. Similar articulated structures used as doormats may be found in U.S. Pat. Nos. 4,766,020; 4,804,570; and 4,654,245. A catalogue by Leichtung Workshops, March 1989, shows a flexible doormat made of wooden slats and spacers that are held together with a polypropylene rope. A more recent catalog by Solutions (1991) shows a walkway. Both catalogues include rigid slats having a grooved side for receiving a matching spacer.

U.S. Pat. No. 5,118,542 issued to the inventor is related to this application. U.S. Pat. No. 5,118,542 describes a walkway assembly useful for making turns. U.S. Pat. No. 305,328 describes a street pavement system in which adjacent rail sections are secured together by rigid bolts.

Although such prior art devices have served the purpose, they have not been widely used by the general public for a variety of reasons. Many prior art devices are designed to be used in only a highly specialized environment. Others incorporate complex combinations of elements making them expensive to manufacture, cumbersome to assemble and disassemble, and difficult to repair and maintain. Other prior art devices also have the disadvantage that the shape of the spacers allow them to become improperly aligned between adjacent rigid bars. While there has been a long recognized need for improvements in the design of such structures, no practical device has yet been devised that resolves many of the current shortcomings. Ideally, a portable supporting surface would be manufactured from a combination of simple elements, be easy to assemble and disassemble, be collapsible into a compact configuration for moving and storage, be easy to clean, and be capable of assuming a variety of shapes so that it may be safely used over irregular surfaces, may be made to follow a winding path or may be positioned on its edge to form a stable support or barrier. The present invention fulfills this need.

SUMMARY OF THE INVENTION

The general purpose of this invention is to provide a portable structure for use as a temporary path, doormat, deck, support, barrier or the like which embraces all the advantages of similarly employed devices while avoiding many of their disadvantages. To attain this, one aspect of the present invention contemplates a unique combination of rigid bars and spacers threaded on a rope. In one embodiment, ends of the spacer and rigid bars can be angled for inclining or declining the assembly In another embodiment, ends of the spacer can be rounded. The rounded ends are received in a corresponding rounded end of a bore of the rigid bar. Another aspect of the invention contemplates a plurality of rigid bars held together by interlocking elements. The interlocking elements can have male and female portions or can be screwed together. Further, the interlocking elements can extend through more than one of the adjacent rigid bars. In all aspects of the invention, the portable structure is formed from a combination of elements that are simple to manufacture and that may be easily assembled and disassembled by a typical user. Additionally, the elements that form the present invention may be combined during manufacture or at a later time by the user to form a specific configuration that lays flat or can turn corners to follow a winding path or may be stood on its edge to act as a support or barrier.

The exact nature of this invention as well as other objects and advantages thereof will be readily apparent from consideration of the following specification relating to the annexed drawings.

DETAILED DESCRIPTION OF THE PREFERRED EMBODIMENT

Figure 1:
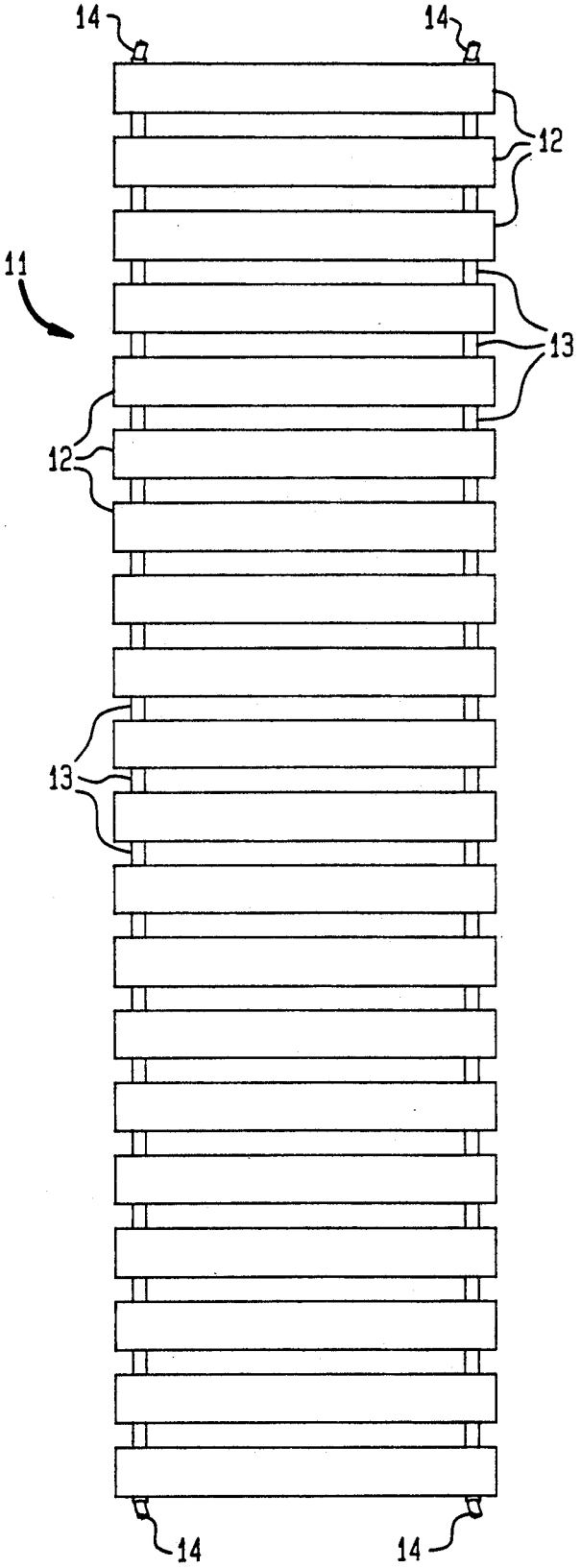
FIG. 1 is a top plan view of a preferred embodiment of the invention.
Figure 2:
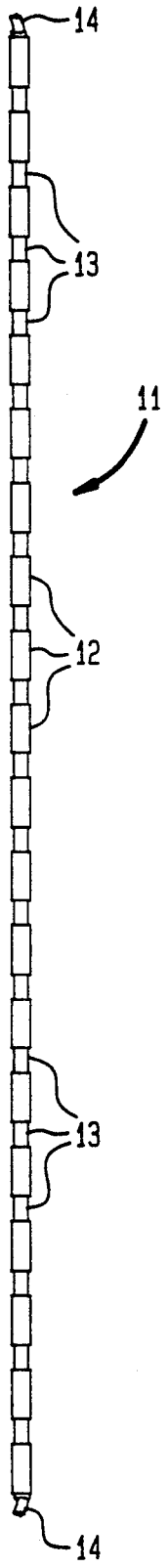
FIG. 2 is a side elevation of the device shown in FIG. 1.

During the course of the description, like numbers will be used to identify like elements according to the different figures which illustrate the invention.

Referring now to the drawings, there is shown in FIGS. 1–4 an assembly 11 composed of a plurality of rigid bars 12, a plurality of spacers 13 and two ropes 14. The bars 12, which may be fabricated from a variety of materials including wood and plastic, generally have rectangular cross-sections and are held in a spaced parallel relation with respect to each other by the spacers 13 and the flexible ropes 14.

Figure 3:
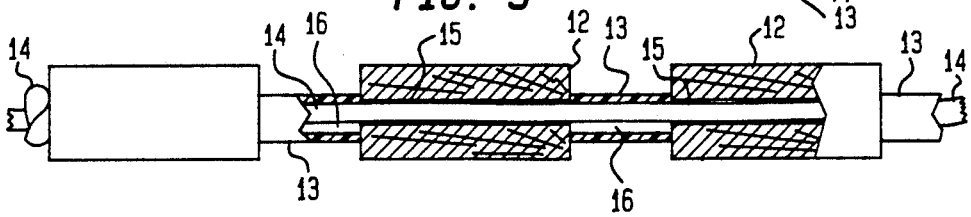
FIG. 3 is a broken-away section of a portion of the device shown in FIG. 2.

As seen in FIG. 3, the bars 12 have bores 15 through which the ropes 14 are threaded. Likewise, the spacers 13, formed as thin-walled plastic cylinders, have bores 16 for receiving the ropes 14. When the elements of the assembly 11 are threaded together, the ropes 14 are preferably pulled taut and knotted at their ends to lightly hold the bars 12 into abutting engagement with the spacers 13. Of course, depending upon the characteristics of the ropes 14, the assembly 11 may eventually become loose due to wear resulting in a permanent stretching of the ropes 14. Although a slack rope 14 will usually have no noticeable effect on the operation of the assembly 11, the loose condition may be rectified by simply removing the slack from ropes 14 by pulling them taut and reknotting their ends.

Figure 5:
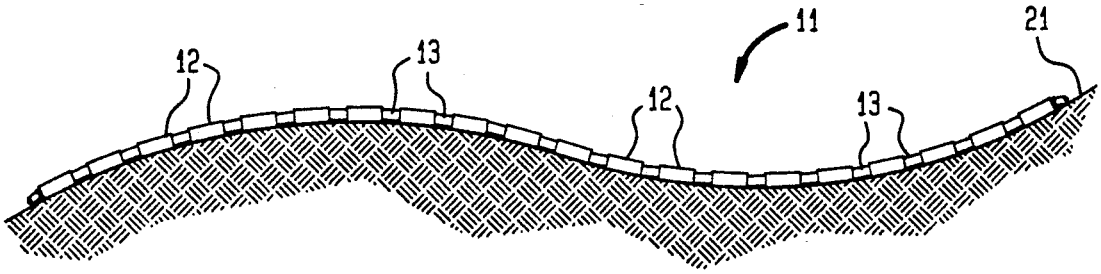
FIG. 5 is an elevation of the preferred embodiment in use on an irregular surface.

It is contemplated that the ropes 14 be sufficiently elastic to permit the assembly 11 to generally follow the contours of an irregular surface when superimposed thereon. FIG. 5 illustrates positions assumed by the bars 12 and spacers 13 when the assembly 11 lies on an irregular surface 21. The elasticity of rope 14 permits the assembly 11 to assume this position. This feature is important since it is contemplated that the assembly 11 be capable of safely acting as a semi-rigid walkway on such surfaces as mud, sand, gravel, etc. These irregular surfaces are typically found at beach areas, recreational camping sites, parks, and the like. It is contemplated that the assembly 11 may also be employed as a vertical barrier in gardens to protect plants or at beach areas to protect sand dunes and the like from damage.

Figure 6:
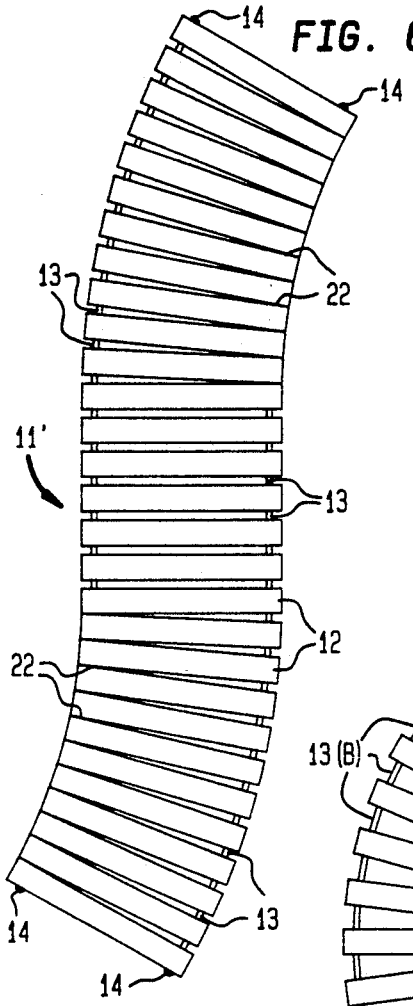
FIGS. 6 and 7 are top plan views of modifications of the preferred embodiment of FIG. 1.
Figure 7:
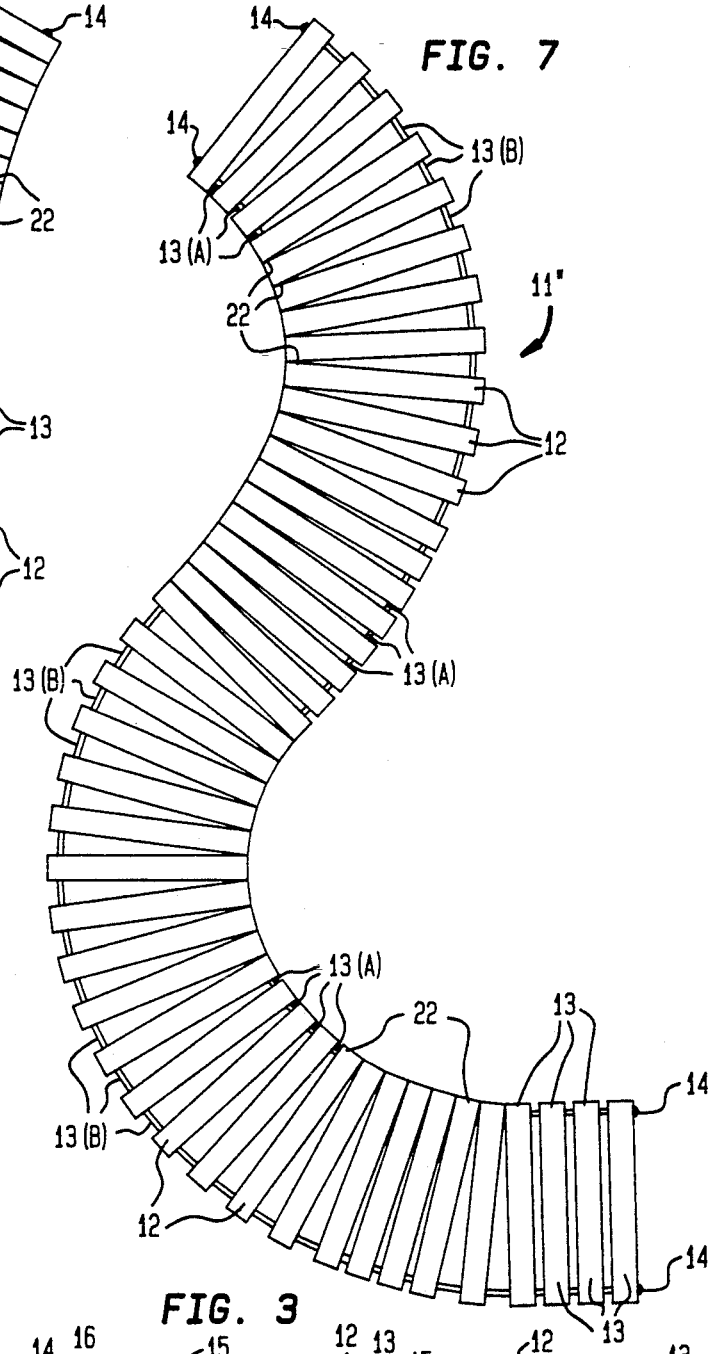

FIGS. 6–7 illustrate yet another important feature of the assembly 11. In the FIG. 6 modification, selective ones of the spacers 13 have been removed, thereby causing one side of the bars 12 to abut each other at the points 22. This modification of the assembly 11 will cause it to assume a curved shape. By selectively removing a sufficient number of spacers 13, the assembly 11 can be made to turn through any desired angle. The rate of curvature may also be adjusted, as seen in FIG. 7, by simply inserting smaller sized spacers 13(A) at one side and/or by inserting larger sized spacers 13(B) at the other side. FIG. 7 illustrates the assembly 11 having various turns using short spacers 13(A), larger spacers 13(B) and regular spacers 13.

Figure 10:
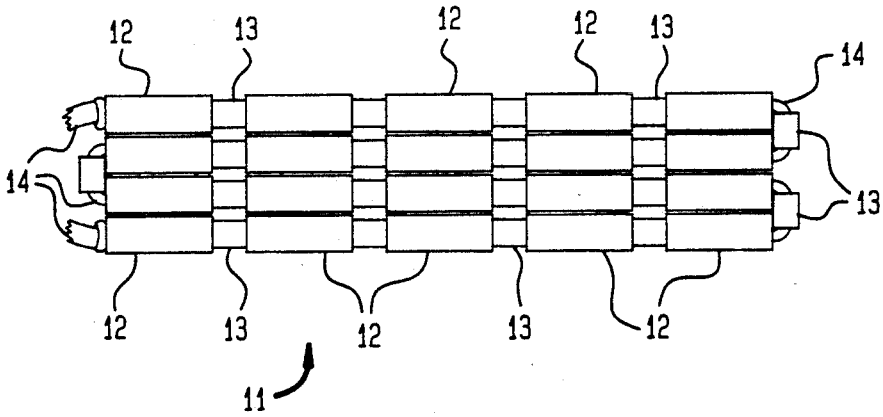
FIGS. 9 and 10 are side elevations of a portion of the preferred embodiment in a collapsed configuration.
Figure 9:
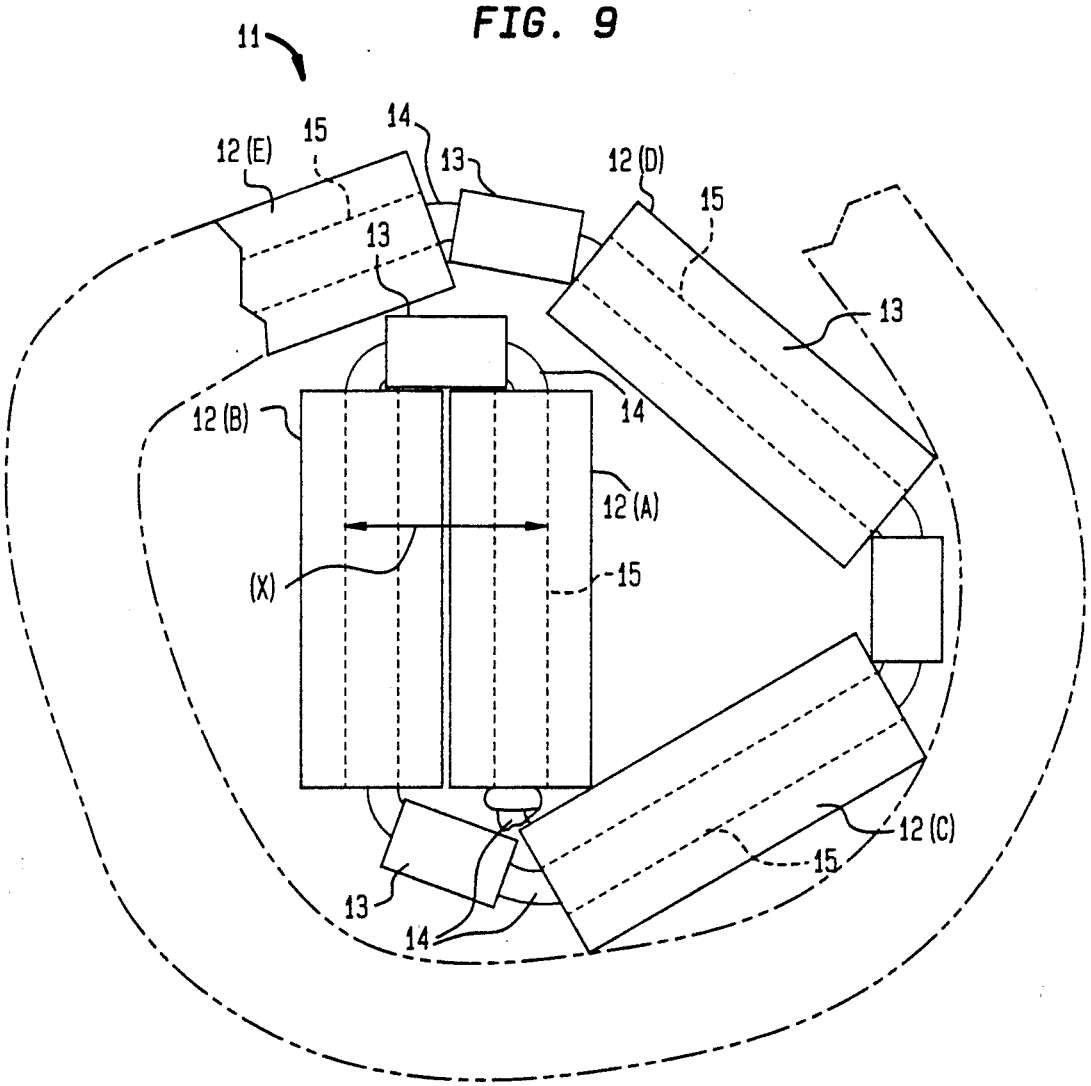

Another important feature of the present invention is the collapsibility of the assembly 11 for storage or for carrying. The assembly 11 may be rolled up on itself as illustrated in FIG. 9 or it may be folded into a neat stack as shown in FIG. 10. The assembly 11 in FIG. 9 shows the end bar 12(A) folded directly onto the second bar 12(B) and the other bars 12(C), 12(D), 12(E), etc. compactly rolled onto each other. To accomplish this, the spacer 13 plus twice the thickness of rope 14 must be substantially equal to the distance indicated by the double-headed arrow (X). Additionally, the ropes 14 must also be sufficiently elastic to stretch the required amounts as seen in FIG. 9. When rolled up as shown in FIG. 9, the assembly 11 forms a compact, generally cylindrical structure, making it easier to store and carry. It is appreciated that in some cases the size of the assembly 11 may be too large to carry. However, due to its compact, cylindrical shape, the assembly 11 may be conveniently moved about in most cases, by rolling it along the ground.

Figures 4, 8:
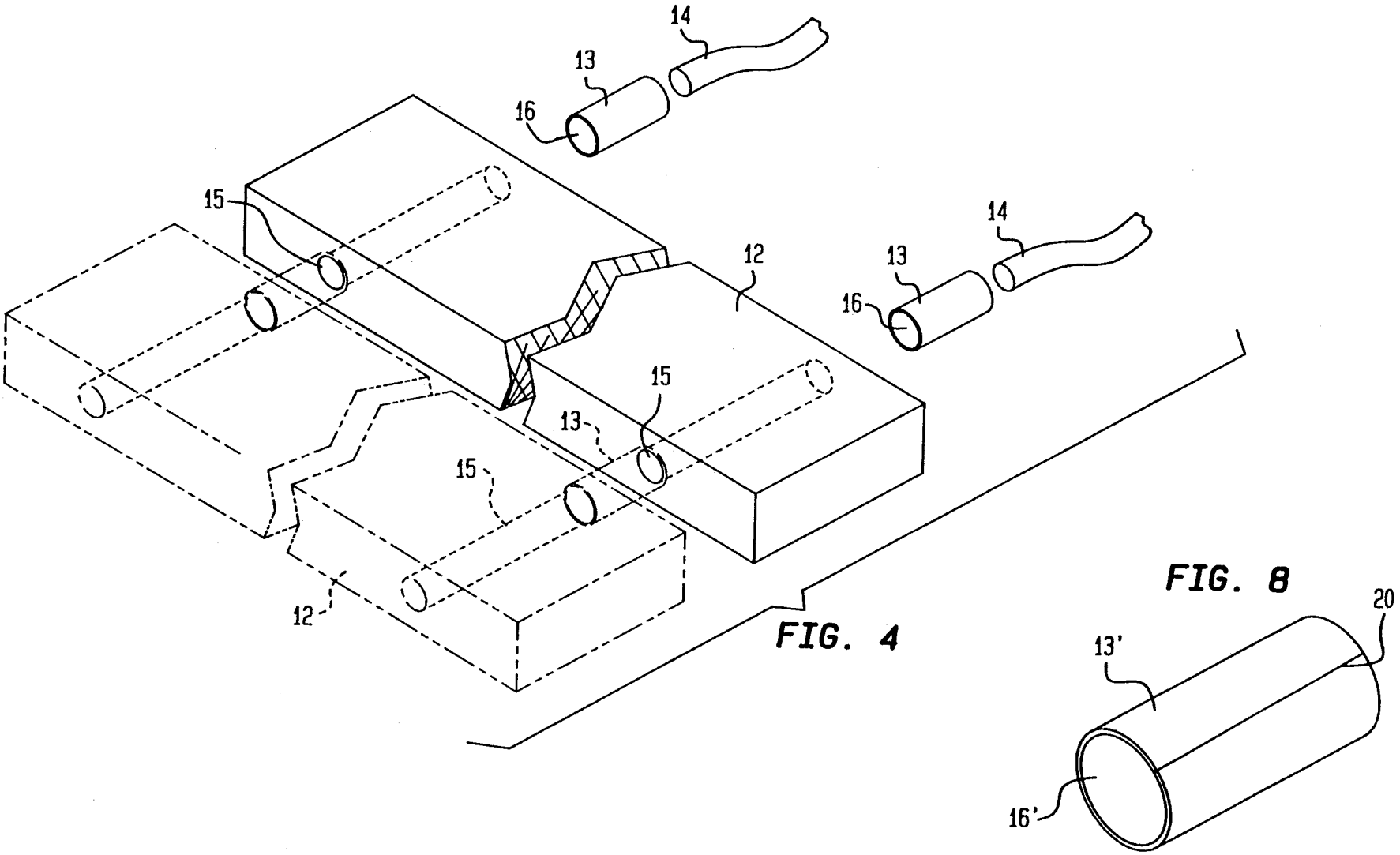
FIG. 4 is an exploded pictorial view of a portion of the preferred embodiment.
FIG. 8 is a pictorial view of a modified portion of the invention.

FIG. 8 illustrates a modified spacer 13' having a longitudinal slit 20 and a rope-receiving bore 16'. The modified spacer 13' is preferably made of a resilient material, such as plastic, so that the slit 20 may be manually spread open by a user for removing or replacing the spacers 13' without having to rethread the ropes 14. The use of spacers 13' will facilitate the assembly and/or easy changing of the configuration of the assembly 11. For example, if the assembly 11 is sold or stored in the normal shape shown in FIG. 1, a user may later readily modify the linear assembly 11 of FIG. 1 to look like the curved assembly 11 of FIG. 6. Using the spacers 13', the change in shape may be accomplished by simply removing the appropriate spacers 13' and readjusting the lengths of ropes 14.

Figure 11:
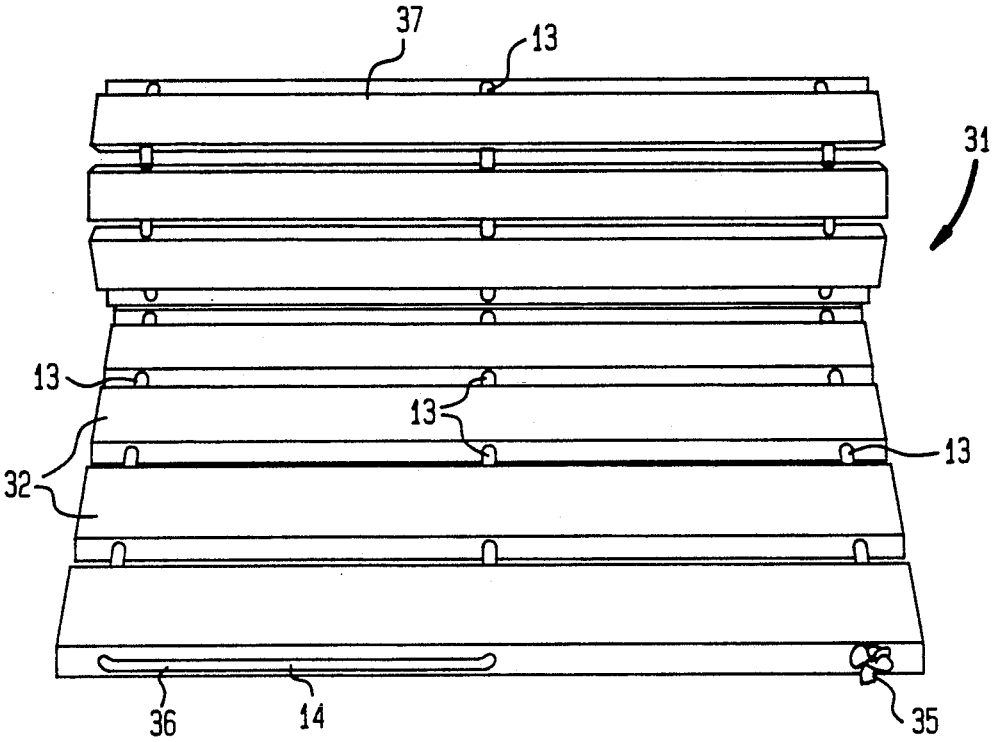
FIG. 11 is a pictorial view of an alternate embodiment in a partially rolled up configuration.

FIG. 11 shows a relatively wide assembly 31 that may be used to cover large areas to form a deck or the like. Assembly 31 is composed of rigid bars 32, similar to bars 12 of FIG. 1, each having three bores through which a rope 14 is threaded. Spacers 13 are mounted on the single rope 14 that is threaded between the bars 32. To thread rope 14, one end is first knotted at 35. The other end is then alternately threaded through the bores on the right side of bars 32 and the spacers 13. The rope 14 is then folded back (not shown) and threaded through the spacers 13 and the center bores of bars 32 and then folded back as at 36 to be threaded through the spacers 13 and the bores on the left side of bars 32. Finally, the rope 14 is pulled taut and knotted (not shown). The assembly 31 is shown partially rolled up at 37.

Figure 12:
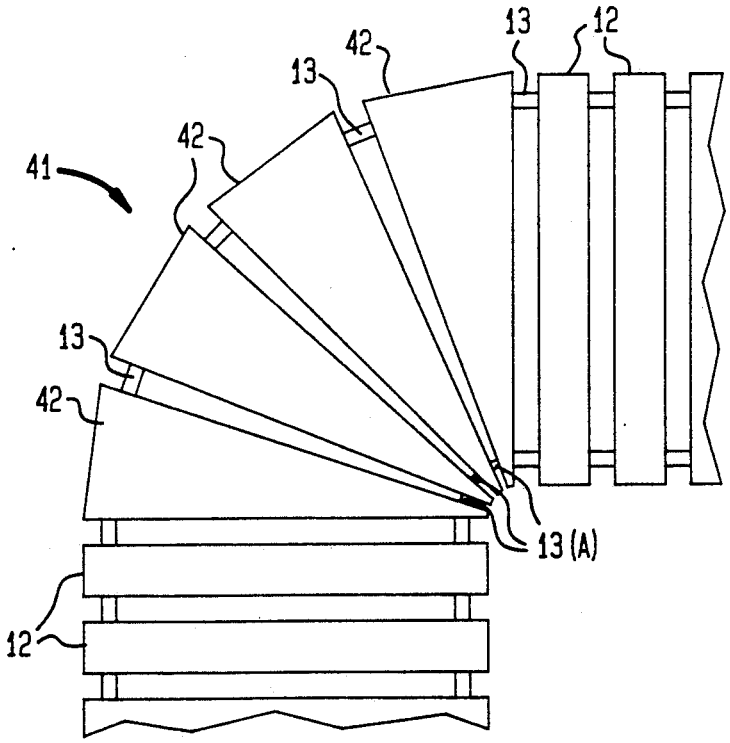
FIG. 12 is a top view, with portions broken away, of a further alternate embodiment.
Figure 13:
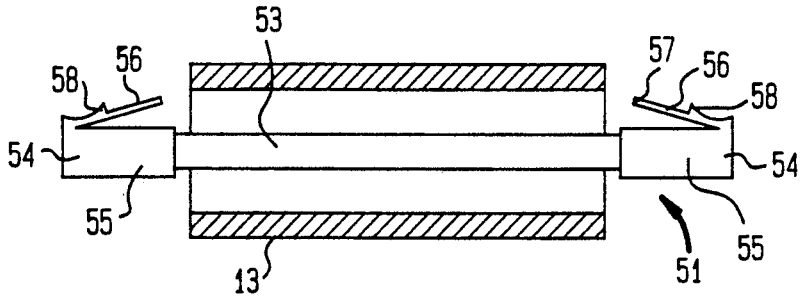
FIG. 13 is a side elevation, partly in section, of still another alternate embodiment.
Figure 14:
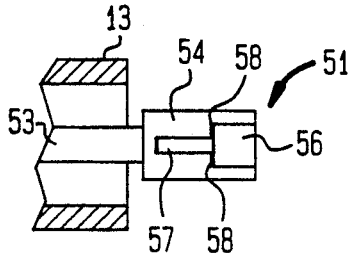
FIG. 14 is a top view, partly in section and broken away, of a portion of the device shown in FIG. 13.
Figure 15:
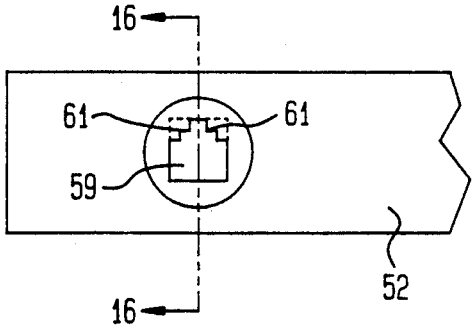
FIG. 15 is an elevation, partly broken away, of a portion of the invention to be used with the embodiments of FIGS. 13 and 14.
Figure 16:
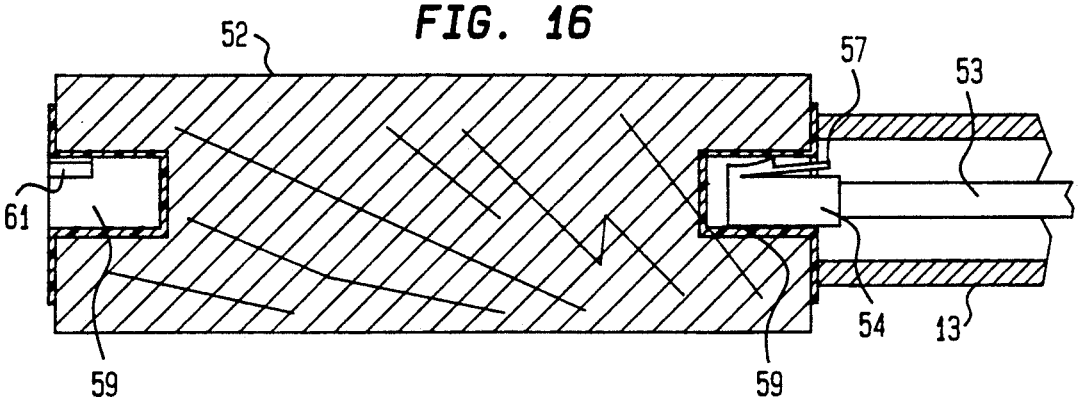
FIG. 16 is a section of the device shown in FIG. 15 taken on the line 16—16 and looking in the direction of the arrows.

FIG. 12 illustrates an assembly 41 having bars 12, as described with respect to FIG. 1, and a plurality of wedge-shaped bars 42 useful for creating an abrupt 90° turn. The bars 42 have bores at either end for receiving rope 14 (not shown). Spacers 13 are placed on the rope 14 except for a number of shorter spacers 13(A) that are shown mounted on the rope 14 between the narrow ends of bars 42.

FIGS. 13–16 illustrate a further modification of the invention wherein flexible interlocking elements 51 are used for joining adjacent bars 52 to form an assembly similar to the assembly 11 (FIG. 1). The interlocking elements 51 include a flexible line 53, which may be made of rope, with modular connectors 54 joined at either end. Connectors 54 include a body portion 55 having a resilient tang 56 joined thereto. Tang 56 includes a finger piece 57 and locking shoulders 58.

The bars 52 are prepared with short cavities into which locking bores 59 are fixed. Bores 59 have openings with shoulders 61 for receiving the connectors 54 when the tang 56 is pressed toward the body 55. Once completely inserted into the bores 59, the tang 56 can expand such that the locking shoulders 58 abut the inside surfaces of the shoulders 61. Further, the lines 53 may be made of different lengths for use in forming turns as shown in FIG. 7. The elements 51, being easy to install and remove, facilitate the making of kits for consumption by the general public.

Figure 17A:
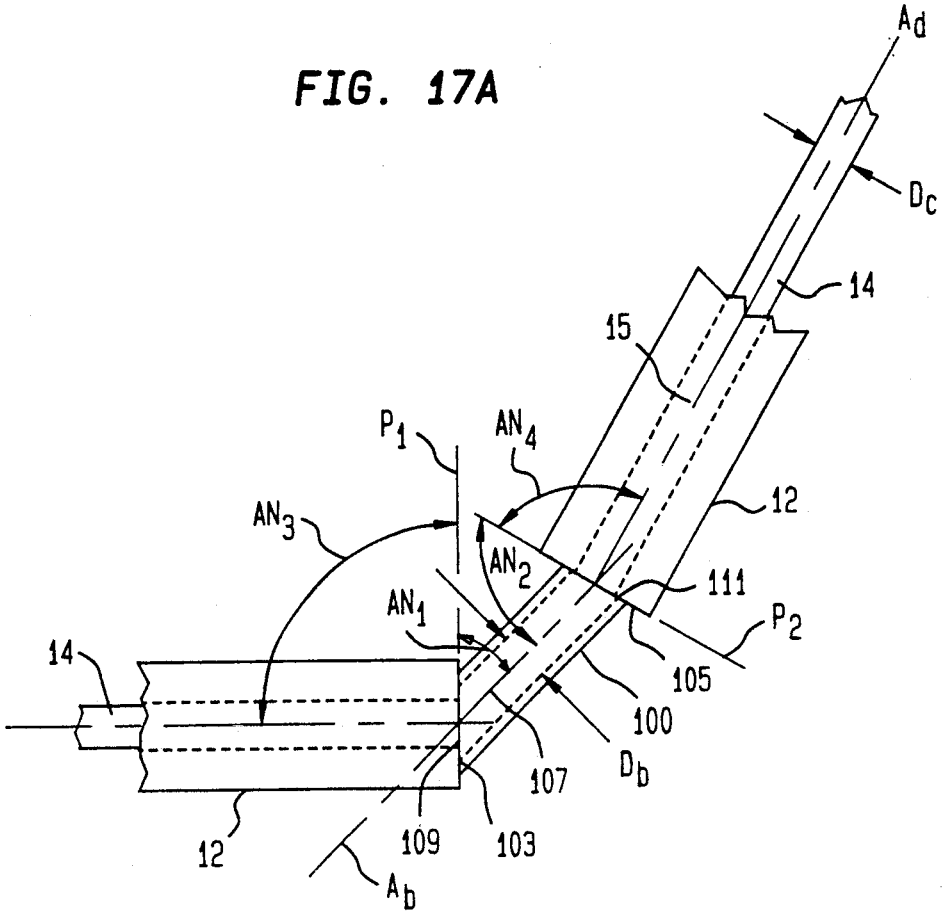
FIG. 17A is a side elevational view of an embodiment of the spacer used on an inclined surface.
Figure 17B:
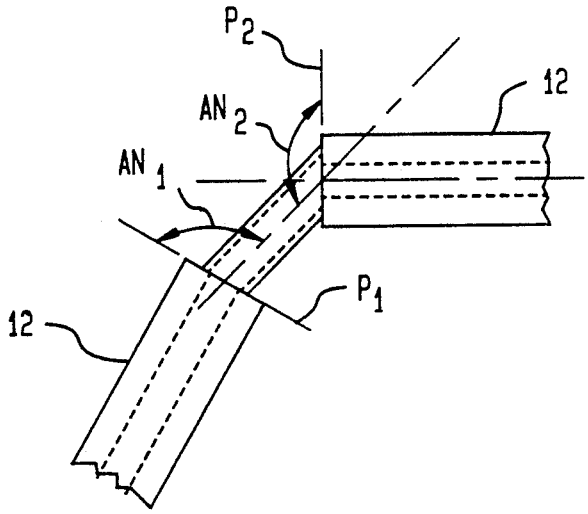
FIG. 17B is a side elevational view of an embodiment of the spacer used on a declined surface.
Figure 18:
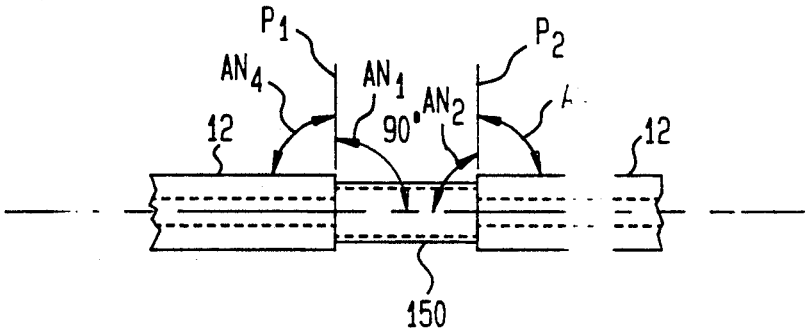
FIG. 18 is a side elevational view of an embodiment of the spacer used on a flat surface.
Figure 19:
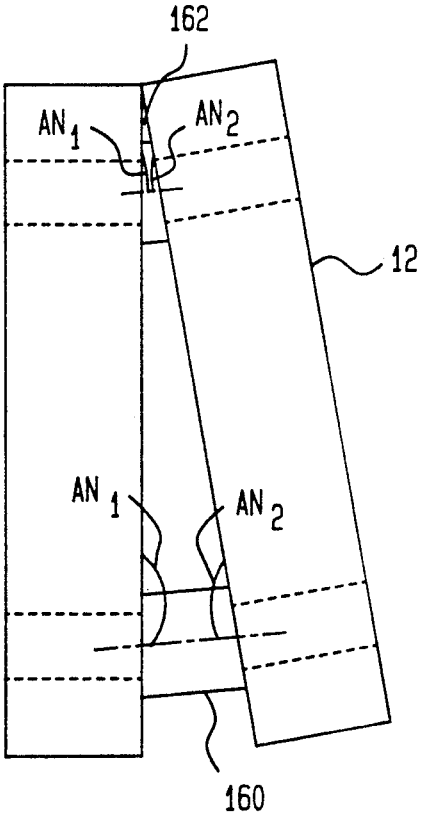
FIG. 19 is a top plan view of an embodiment of the spacer used for making turns.

FIGS. 17–19 illustrate embodiments of the spacer in which the spacer is used to form various orientations of adjacent bars 12. As shown in FIG. 17A, bore 107 extends the length of spacer 100. Rope 14 is threaded through bore 107 into bores 15 of rigid bars 12. Bore 15 has axis Ad. Bore 15 can extend less than the entire length of bar 12. Spacer 100 has axis $A_b$. Spacer 100 has a first end 103 and a second end 105. Ends 103 and 105 are defined by respective planes $P_1$ and $P_2$. Angle $AN_1$ extends between axis $A_b$ and plane $P_1$ and angle $AN_2$ extends between axis $A_b$ and plane $P_2$. Angle $AN_3$ extends between axis $A_d$ and plane $P_1$ and angle $AN_4$ extends between axis $A_d$ and plane $P_2$. Spacer 100 can be integrally formed with an end of rigid bar 12.

Ends 103 and 105 of the spacer are varied depending on the desired angle of $AN_1$ and $AN_2$. Bar ends 109 and 111 are varied depending on the desired angle of $AN_3$ and $AN_4$. For example, as shown in FIG. 17A, adjacent rigid bars 12 are orientated on an incline when angles $AN_1$ and $AN_2$ are less than 90° or when angles $AN_3$ or $AN_4$ are less than 90°. Similarly, adjacent bars 12 are orientated on a decline when angles $AN_1$ and $AN_2$ are greater than 90° or when $AN_3$ and $AN_4$ are greater than 90°, as shown in FIG. 17B.

FIG. 18 illustrates a spacer 150 for forming a flat orientation of adjacent rigid bars 12. Spacer 150 has angles $AN_1$, $AN_2$, $AN_3$ and $AN_4$ equal to 90°.

FIG. 19 illustrates an orientation of rigid bars 12 used for making turns. In this orientation, spacers 160 and 162 are positioned between adjacent bars 12. Spacer 160 has angles $AN_1$, $AN_2$, $AN_3$ and $AN_4$ of about 45°. Spacer 162 has angles $AN_1$ and $AN_2$ which are smaller than angles $AN_1$ and $AN_2$ of spacer 160. Preferably, angles $AN_1$ and $AN_2$ of spacer 162 are about 30°.

Figure 20:
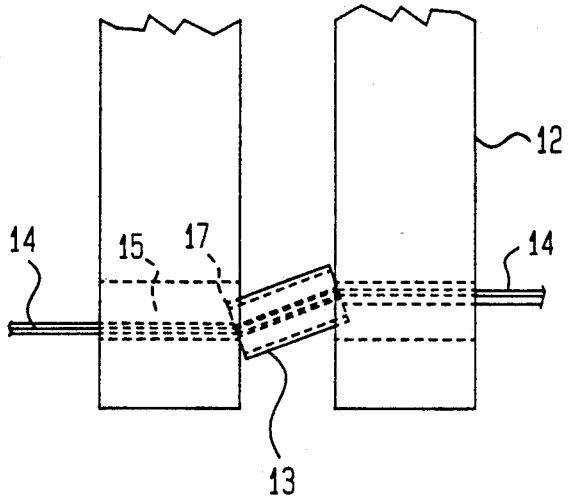
FIG. 20 is a top plan view of a problem encountered with spacers.

FIG. 20 shows a problem encountered in the positioning of spacers between adjacent rigid bars 12. When rope 14 is held in tension, spacer 13 can become lodged in a position which is at an angle to rigid bars 12. In this position, spacer 13 is misaligned with respect to rigid bars 12. An end 17 of spacer 13 is lodged in bore 15. This misaligned position of spacer 13 has the disadvantage of not providing proper alignment of rigid bars 12 and of providing undesired movement between adjacent rigid bars 12.

Figure 21:
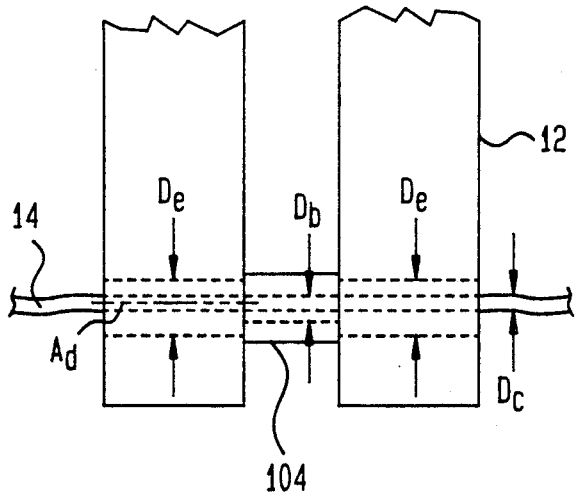
FIG. 21 is a top plan view of an embodiment of a spacer having a predetermined diameter.

FIG. 21 illustrates an embodiment of the spacer for solving the problem of a misaligned spacer between adjacent rigid bars 12. Spacer 104 has axial bore diameter $D_b$. Rope 14 has diameter $D_c$. In this embodiment, axial bore diameter $D_b$ is no more than 150% greater than the diameter $D_c$. Rigid bar 12 has rigid bore diameter $D_e$. Diameter $D_e$ is no more than 150% greater than rope diameter $D_c$. These bore diameters have the advantage of reducing movement of spacer 104 with respect to axis $A_d$ of bore 15 and thus reducing or eliminating spacer misalignment. Also, the rigid bar misalignment is reduced or eliminated.

Figure 22:
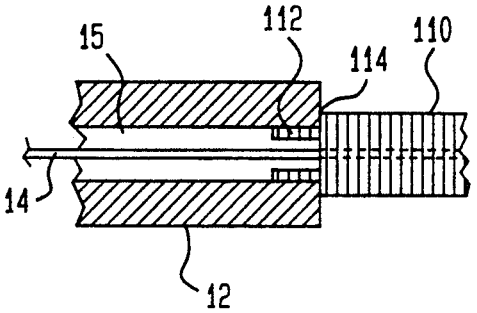
FIG. 22 is a side elevational view of an embodiment of a spacer including protrusions extending from an end of the spacer.

FIG. 22 illustrates a second solution for solving the problem of a misaligned spacer. An embodiment of the spacer has protrusions 112 extending from end 114 of spacer 110. Protrusions 112 contact the inside of bore 15 for preventing movement of the spacer with respect to rigid bars 12.

Figure 23:
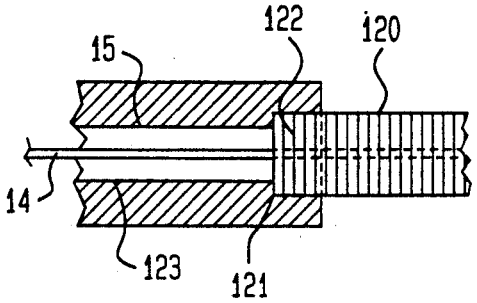
FIG. 23 is a side elevational view of an embodiment of a spacer including a larger diameter bore at the end of the bar.

FIG. 23 illustrates a third solution for providing stability of the spacer between adjacent bars 12. In this embodiment of the spacer, end 122 of spacer 120 is fitted into end 121 of bore 15 for preventing movement of spacer 120 with respect to rigid bars 12. End 121 of bore 15 can have a larger diameter than section 123 of bore 15. It will be understood that other methods for preventing movement of the spacer with respect to the rigid bars are possible in light of the above teachings.

Figure 24:
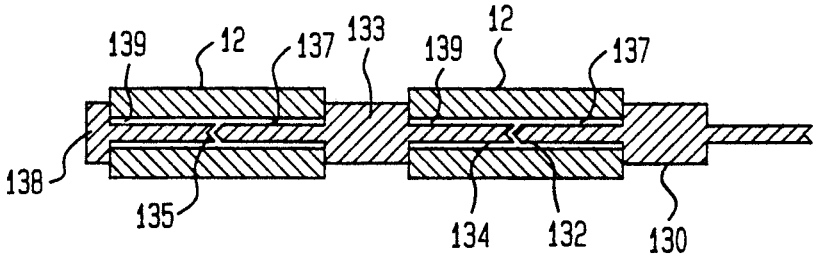
FIG. 24 is a side elevational view of an embodiment of a spacer showing an interlocking assembly for joining adjacent bars.

FIG. 24 illustrates an embodiment of the spacer of an interlocking assembly for joining adjacent bars 12 to form an assembly similar to assembly 11 (FIG. 1). Interlocking element 130 includes a male end 132 and a female end 134. The male end 132 and female end 134 are located on either side of central section 133. Bore 15 has a first end 137 and a second end 139. Male end 132 of one of the coupling elements 130 is positioned in first end 137 of the bore and female end 134 of an adjacent interlocking element 133 is positioned in second end 139 of the bore. Once adjacent coupling elements 130 are completely inserted into bore 135, male end 132 engages with female end 134. Upon insertion of the interlocking element, central portion 133 of interlocking element 130 is positioned between adjacent bars 12. Preferably at least one of the male end 132 or female end 134 is an integral part of central portion 133. Male end 132, female end 134 and central portion 133 are preferably made of a flexible material. Cap 138 engages male end 135.

Figure 25:
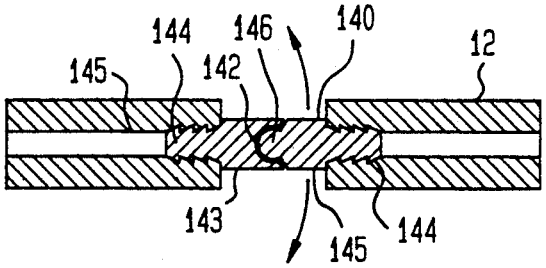
FIG. 25 is a side elevational view of an embodiment of a spacer showing a threaded coupler assembly for joining adjacent bars.

FIG. 25 illustrates an embodiment of the spacer of a threaded coupler assembly 140 for joining adjacent bars 12. Threaded coupler assembly 140 includes threaded ends 144. Threaded ends 144 are engaged with bore 145. Threaded coupler assembly 140 is formed of two body sections 143 and 145. Pocket 142 of section 143 receives rounded end 146 of section 145 for engagement thereto. The use of two releasable sections 143 and 145 allows adjacent bars to be easily changed by disengaging section 143 from section 145.

Figure 26:
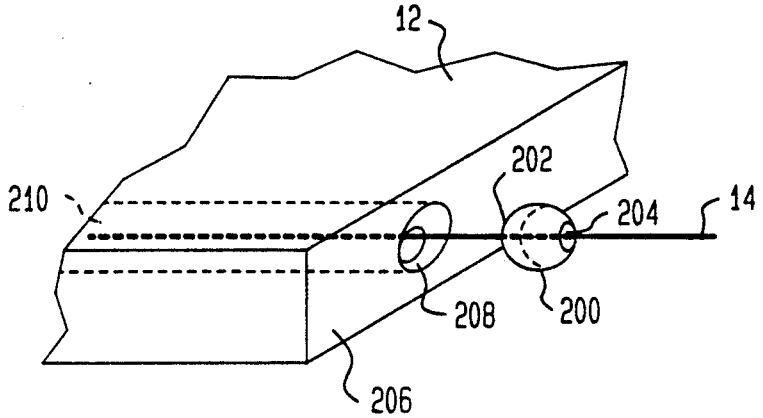
FIG. 26 is a perspective view of an embodiment of a spacer having a rounded circular shape.

FIG. 26 illustrates an embodiment of a spacer in which spacer 200 has a rounded circular shape. End 206 of rigid bar 12 has a depression 208 for receiving end 202 of spacer 200.

Figure 27:
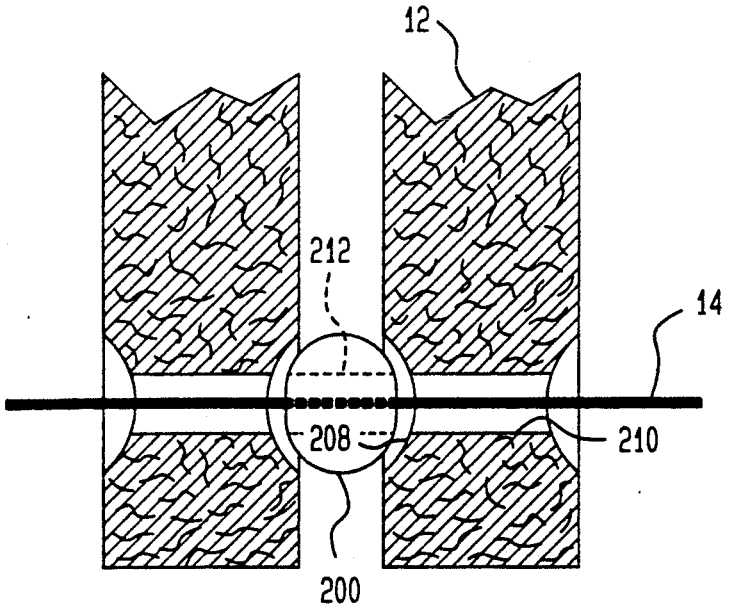
FIG. 27 is a top plan view of the rounded circular spacer.

As shown in FIG. 27, rope 14 is threaded through bore 212 of spacer 200 into bores 210 or adjacent rigid bars 12.

Figure 28:
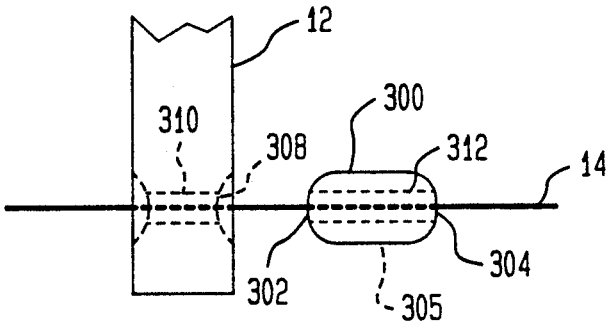
FIG. 28 is a top plan view of an embodiment of the spacer having an oblong rounded shape.

FIG. 28 illustrates a seventh embodiment of the spacer in which spacer 300 has a rounded ends 302, 304 with an oblong middle portion 305. End 302 is received in depression 308 of rigid bar 12. Rope 14 is threaded through bore 312 of spacer 300 into bore 310 of rigid bar 12. The rounded modifications of the spacers prevents movement of the spacer with respect to the rigid bars for preventing misalignment of the spacer. In a preferred embodiment, spacers 200 and 300 are formed of a flexible material for allowing assembly 11 to be folded into a neat stack as shown in FIG. 10.

Figure 29:
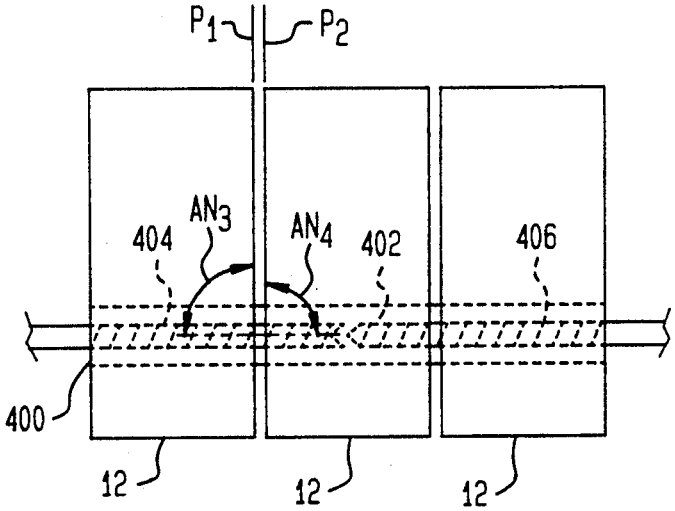
FIG. 29 is a top plan view of an embodiment of the spacer of an interlocking assembly for joining more than one adjacent bar.

FIG. 29 illustrates an embodiment of the spacer including modification of the interlocking assembly. Interlocking assembly 400 includes a male end 404 and a female end 402. Preferably male end 404 and female end 402 are inserted into bore 406 of a plurality of rigid bars 12. After the male 404 and female 402 ends are inserted into bore 406, male end 404 engages with female end 402. It is contemplated that assembly 400 can be used for forming decks of numerous adjacent bars.

Obviously many other modifications and variations of the present invention are possible in the light of the above teachings. For example, the assembly 11 may be laid on a surface to form a walkway or be laid over a frame to form a latticework or be stood on its edge to form a barrier. Still further, the assembly 11 may be rolled into a cylindrical shape and stood on its edge and used as a base support for a table top or the like. When used as a walkway, the edges of the bars 12 may be tapered and in some cases spiked anchors may be connected to the assembly 11 and be driven into the ground to prevent movement of the assembly with respect to the ground.

It is, therefore, to be understood, that within the scope of the appended claims, the invention may be practiced otherwise than as specifically described.

I claim:

1. An assembly of articulated members comprising:

a plurality of rigid bars, each said bar having at least two bores formed therein, said bores in said bars extending through said bars, each of said bars having an axis Ad;

flexible connecting means extending between said bars and into said bores for articulating said bars with respect to each other, said flexible connecting means including at least one rope having a diameter of $D_c$; and, a plurality of spacers having axial bores with an inside bore diameter $D_b$ and with an axis $A_b$, each of said spacers mounted on said connecting means between adjacent ones of said bars and having a first and a second end defined by a first and second plane $P_1$ and $P_2$, respectively, angle $AN_1$ extends between $A_b$ and $P_1$, angle $AN_2$ extends between $A_b$ and $P_2$, angle $AN_3$ extends between $P_1$ and $A_d$ and angle $AN_4$ extends between $P_2$ and $A_d$, wherein said connecting means extends through said bores and into said bars and through said axial bores in said spacers.

2. The assembly of claim 1 wherein the angles $AN_1$, $AN_2$, $AN_3$ and $AN_4$ are 90°.

3. The assembly of claim 1 wherein at least one of the angles $AN_1$, $AN_2$, $AN_3$ and $AN_4$ is less than 90°.

4. The assembly of claim 1 wherein at least one of angles $AN_1$, $AN_2$, $AN_3$ or $AN_4$ is greater than 90°.

5. The assembly of claim 1 wherein the diameter of the axial bore $D_b$ is no more than 150% greater than the diameter $D_c$ of the flexible connecting means.

6. The assembly of claim 1 wherein each of the rigid bars has a rigid bore diameter $D_e$, diameter $D_e$ is no more than 150% greater than the diameter $D_c$ of the flexible connecting means.

7. The assembly of claim 1 wherein angles $AN_1$, $AN_2$, $AN_3$ and $AN_4$ are less than 90°.

8. The assembly of claim 1 wherein angles $AN_1$, $AN_2$, $AN_3$ and $AN_4$ are greater than 90°.

9. The assembly of claim 1 wherein angle $AN_1$ is less than angle $AN_2$ and angle $AN_3$ is less than angle $AN_4$.

10. The assembly of claim 1 further comprising:

bore alignment means attached to at least one end of each of said spacers for engaging at least one of said bores formed in said rigid bar, said bore having an axis $A_d$, wherein said bore alignment means tends to keep said spacers in alignment with said axis $A_d$ of said bore.

11. The assembly of claim 10 wherein said bore engagement means includes threads for securing said engagement means into said bore.

12. The assembly of claim 11 wherein said bore engaging means includes protrusions for contacting the inside of said bore.

13. The assembly of claim 1 wherein said spacer is tubular.

14. The assembly of claim 1 wherein said flexible connecting means is elastic.

15. The assembly of claim 1 wherein said rope includes means for holding said rope in tension such that said bars and spacers abut each other.

16. The assembly of claim 1 wherein said spacer means has rounded ends and each said bar has at least two bores formed therein, each end of said bores including a depression, said rounded end of said spacer means being received in said depression of said bore.

17. The assembly of claim 1 wherein said bars have flat upper and lower surface and wherein said flexible connecting means permits said assembly to be folded with said flat upper and lower surfaces superimposed on each other.

18. The assembly of claim 1 wherein said bars have flat upper and lower surfaces and wherein said flexible connecting means permits said assembly to be rolled up on itself with portions of said flat upper and lower surfaces superimposed on each other.

19. A supporting surface apparatus comprising:

a plurality of rigid bars having relatively flat upper and lower surfaces, each said bar has at least two bores formed therein, each end of said bores including a depression;

spacer means mounted between said bars for holding said bars in a spaced relationship with respect to each other, said spacer means has a rounded end, said rounded end of said spacer means being received in said depression of said bore; and, a plurality of securing means passing into said bars for holding said bars in an abutting relationship to said spacer means.

20. A supporting apparatus comprising:

a plurality of rigid bars having relatively flat upper and lower surfaces;

spacer means mounted between said bars for holding said bars in a spaced relationship with respect to each other; and, a plurality of securing means passing into said bars for holding said bars in an abutting relationship to said spacer means, wherein each securing means has a first end and a second end, and wherein the first end of each securing means is engagable with a second end of another securing means.

21. The apparatus of claim 20 wherein at least one of said securing means is an integral part of at least one of said spacer means.

22. The apparatus of claim 21 wherein said first end of at least one of said securing means is a male end and wherein said second end of said securing means is a female end.

23. The apparatus of claim 22 wherein said rigid bars have at least two bores therein and wherein said male and female ends of said securing means engage each other in said bores.

24. The apparatus of claim 23 wherein said male end passes through a first set of said plurality of rigid bars and and female ends passes a second set of said plurality of rigid bars.

25. The apparatus of claim 24 wherein said securing means is flexible.

26. The assembly of claim 20 wherein said securing means permits said bars to be folded with said flat upper and lower surfaces superimposed on each other.

27. The assembly of claim 20 wherein said securing means permits said assembly to be rolled up on itself with portions of said flat upper and lower surfaces superimposed on each other.

28. A supporting surface apparatus comprising:

a plurality of rigid bars having flat upper and lower surfaces and a bore therein;

a plurality of first spacer means each including a first spacer engaging end having a pocket end; and, a plurality of second spacer means each including a second spacer engaging end having a rounded end, said first spacer means and said second spacer means each including a threaded end for threaded engagement with said bore, wherein said rounded end of said second spacer means engages said pocket end of said first spacer means to hold said bars in spaced relationship with respect to each other.

29. A supporting surface apparatus comprising:

a first and second set of a plurality of rigid bars having at least two bores therein; and a plurality of securing means having a male and female end, said male and female end of said securing means engaging each other in said bores, wherein said male end passes into said first set of said plurality of rigid bars and said female end passes into said second set of said plurality of rigid bars.

30. An assembly of articulated members comprising:

a plurality of rigid bars, each said bar having at least two bores formed therein, said bores in said bars extending through said bars, each of said bores having an axis Ad; and flexible connecting means extending between said bars and into said bores for articulating said bars with respect to each other, said flexible connecting means including at least one rope having a diameter of $D_c$, said bars having a first and second end defined by a first and second plane $P_1$ and $P_2$, respectively, angle $AN_3$ extends between $P_1$ and Ad and angle $AN_4$ extends between $P_2$ and Ad, wherein said connecting means extends through said bores and into said bars and through said axial bores in said spacers.

31. The apparatus of claim 30 wherein a male end passes through a first set of said plurality of rigid bars and a female ends passes a second set of said plurality of rigid bars.

* * * * *